United States Patent [19]

Howey

[11] 4,445,253

[45] May 1, 1984

[54] QUICK RELEASE HELMET AND STRAP ASSEMBLY

[76] Inventor: Thomas L. Howey, 1678 Hooke Oak Ave., Chico, Calif. 95926

[21] Appl. No.: 390,173

[22] Filed: Jun. 21, 1982

[51] Int. Cl.[3] ..... A42B 7/00

[52] U.S. Cl. ..... 24/68 E; 24/71 ST; 24/115 F; 24/197; 2/421

[58] Field of Search ..... 24/68 E, 71 ST, 3 K, 24/115 F, 197; 2/421; 297/483

[56] References Cited

U.S. PATENT DOCUMENTS

| | | | |
|---|---|---|---|
| 357,597 | 2/1887 | Hazelton | 24/197 |
| 1,603,484 | 10/1926 | Meissner | 24/197 |
| 1,697,833 | 1/1929 | Lane | 24/197 |
| 3,147,526 | 9/1964 | Winson | 24/197 |
| 3,187,342 | 6/1965 | Aileo | 2/421 |
| 3,314,077 | 4/1967 | Marchello | 2/421 |
| 3,990,113 | 11/1976 | Coenen | 2/421 |
| 4,347,630 | 9/1982 | Arai et al. | 2/421 |

FOREIGN PATENT DOCUMENTS

| | | | |
|---|---|---|---|
| 9408 | of 1927 | Australia | 24/197 |
| 1172388 | 11/1969 | United Kingdom | 2/421 |

*Primary Examiner*—Victor N. Sakran

*Attorney, Agent, or Firm*—Poms, Smith, Lande & Rose

[57] ABSTRACT

In order to permit the quick release of a motorcycle rider's helmet when a bee or wasp is trapped inside the visor, a quick release arrangement for operation with only one hand is provided. The normal strap arrangements for a helmet include a first strap extending from one side of the helmet and carrying two D-Rings secured to the end of this strap. The other strap is threaded through the two D-rings, and then back through the outer one of the two D-rings so that friction between the two portions of the second strap holds the helmet tightly in place. The present disclosure involves the addition of a release member which extends around the second strap between the point where it is threaded through the two D-rings and the point where it extends back through the outer D-ring. By pulling on this release member, the strap assembly may be released with only one hand so that the motorcycle rider can continue guiding the motorcycle with his other hand. An additional stop member such as a ring may be secured to the end of the second strap so that the release member is not lost as a result of full separation of the two straps.

10 Claims, 6 Drawing Figures

QUICK RELEASE HELMET AND STRAP ASSEMBLY

FIELD OF THE INVENTION

The present invention relates to quick release arrangements for helmet straps or the like.

BACKGROUND OF THE INVENTION

Conventional motorcycle and other helmets are provided with chin straps to hold the helmet in place on the rider in case of accident or the like. These chin strap assemblies normally include a first strap secured to one side of the helmet and carrying two rings, which are characteristically in the form of the letter "D" secured at the outer end of the first strap; and a second strap secured to the other side of the helmet which is threaded through both of the two D-rings and then back through the outer one of the two D-rings, so that frictional engagement between two portions of the second strap holds the helmet in place.

A number of serious motorcycle accidents have occurred as a result of a wasp or a bee becoming trapped inside the visor of the helmet against the face of the motorcycle rider. A high level of panic often ensues, and because the conventional helmet strap requires two hands to loosen the straps, the motorcycle rider is likely to release both hands from the motorcycle handlebars in a frantic effort to remove the helmet. This has on a number of occasions caused loss of control of the motorcycle and severe injury to the rider, and in many other cases has almost caused accidents.

Accordingly, a principal object of the present invention is to provide a quick release assembly for the helmets of motorcycle riders or other persons whereby retaining chin straps may be easily released with one hand, and the helmet removed, all while the rider is maintaining control of the motorbike with his other hand.

SUMMARY OF THE INVENTION

In accordance with the present invention, a normal helmet strap assembly of the type described hereinabove is provided with an additional release member which is threaded over the second strap of the helmet strap arrangement between the point where the strap extends through the two outer D-rings and the point where it is threaded back through the D-ring. This release member is provided with a handle or additional opening whereby it may be gripped by the user and pulled to release the chin straps.

In addition, the assembly may be provided with arrangements for preventing the loss of the release member as the chin straps are loosened. This may take the form of an enlargement or an additional member secured to the end of the second chin strap so that either the outer D-ring and/or the release member cannot fit over this stop element.

With this type of addition to the normal helmet securing arrangements, the motorcycle rider may pull on the release member, thereby loosening the chin strap, and remove the helmet, all with one hand, while he is continuing to guide his motorcycle with his other hand. Accordingly, the likelihood of a motorcycle accident under the adverse conditions described above, is significantly reduced. Incidentally, the inventor in the present case had the experience of nearly being involved in an accident as a result of a bee or a wasp being trapped inside his helmet visor, prior to making the present invention; and then, after he had made his initial prototype implementing the present invention, had another similar occasion when a wasp or bee was trapped inside his visor, and successfully released the chin straps and removed his helmet all with one hand, with no danger, and no risk of an accident.

Other objects, features and advantages of the present invention will become apparent from a consideration of the drawings.

DETAILED DESCRIPTION

Figure 1:
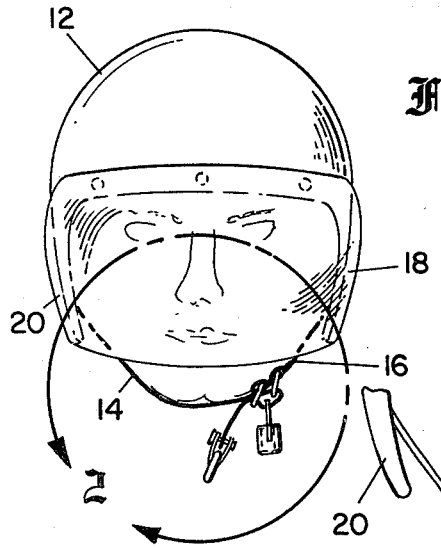
FIG. 1 is an overall assembly drawing illustrating the principles of the present invention.

Referring more particularly to the drawings, FIG. 1 shows a motorcycle helmet 12 provided with chin straps 14 and 16 all as more fully described in connection with FIG. 2.

Figure 2:
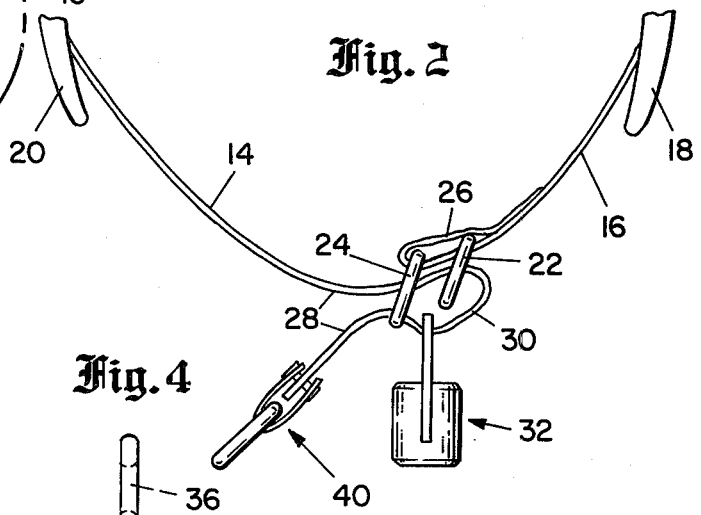
FIG. 2 is an enlarged view of the chin strap assembly of FIG. 1.

In FIG. 2, one of the chin straps 16 is secured to one side 18 of the helmet 12, and the other chin strap 14, is secured to the other side 20 of the helmet 12. At the outer end of the strap 16 are secured an inner ring 22 and an outer ring 24. These two rings are preferably flatened at their upper portions where they slip through the loop 26 at the end of the strap 16. In view of this flattened portion of the rings 22, 24, they are normally referred to as "D-rings".

The strap 14 is normally threaded through both of the two D-rings 22 and 24, and then back through the D-ring 24. The strap 14 is normally made of nylon or other fabric material having high strength, and a sufficiently textured or rough outer surface, so that, where the surfaces 28 of the two sections of the strap 14 are brought into engagement as the strap is tightened, the surfaces 28 have sufficient frictional engagement that the helmet 12 is held firmly in place.

Under normal usage with conventional straps, two hands must be employed to loosen the straps. One hand is employed to push the outer end of the strap 14 toward the D-ring 24, and the other hand is employed to pull on the loop 30 between D-ring 24 and D-ring 22.

Figure 3:
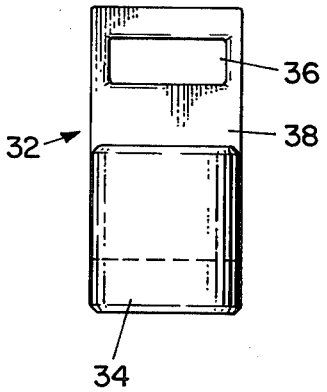
FIGS. 3 and 4 are front and side views, respectively, of the quick release member shown in the assembly view of FIG. 2.
Figure 4:
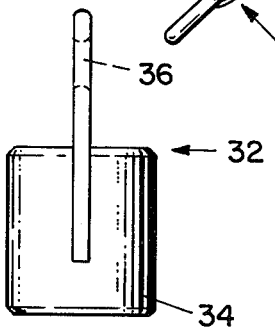

In the present assembly illustrating the principles of the invention, an additional member 32 is provided, and this release member 32 is shown in greater detail in FIGS. 3 and 4. More specifically, the release member 32 includes a handle 34 and an opening 36, through which the strap 14 is threaded, after it has been passed through the two D-rings 22 and 24, but before it has been passed back through the outer D-ring 24. Accordingly, when it is desired to release the chin strap 14 and 16, the user may grip the handle portion 34 and pull on it, thereby releasing the loop 30, as shown in FIG. 2, and opening the assembly.

The release element 32 may be made in two parts, as shown, with the handle portion 34 being secured to the member 38 which carries the opening 36. The member 38 having the opening 36 should be configured of metal or high strength plastic, and should have a relatively low friction opening for easy sliding along the surface of the strap 14, as release is accomplished.

Figure 5:
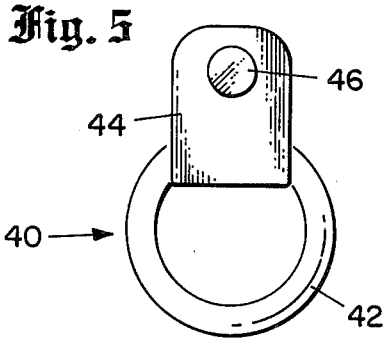
FIGS. 5 and 6 are front and side views, respectively, of the stop member included in FIG. 2, which prevents loss of the release member.
Figure 6:
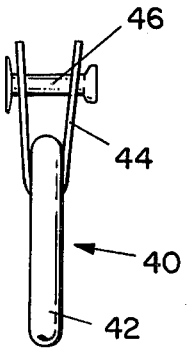

Preferably, the outer end of the strap 14 should be provided with some suitable stop arrangement, such as the stop assembly 40 shown in greater detail in FIGS. 5 and 6. This stop member 40 may include a metal ring 42 of sufficient diameter that it cannot pass through the opening in D-ring 24, and a simple clip 44 and rivet 46 for securing to the end of the strap 14. Alternatively, the end of the strap 14 may be merely turned back and forth upon itself two or three times, and the slot 36 in release member 32 made sufficiently narrow so that the end of the strap 14 will not slide through it.

In conclusion, it is to be understood that the foregoing description and the accompanying drawings merely relate to one illustrative embodiment of the invention. Other variations are considered to be within the scope of the present invention. For example, the release member 32 may be made of any suitable high strength low friction material, such as plastic or metal, and instead of the enlarged portion 34 for gripping with one hand, the release member 32 may have a second larger opening, similar to opening 36, but large enough so that a couple of fingers could extend through it to apply releasing force to the loop 30, as shown in FIG. 2. The members 22, 24 need not be D-rings, although such configuration is advantageous but could have openings of other shapes, as long as they are effective to hold the straps together by frictional forces until loosened. Similarly, and as mentioned above, other stop arrangements could be provided for preventing the loss from the assembly of the release member 32, which could be different from that shown at 40, in FIGS. 2, 5 and 6 of the drawings. Accordingly, it is to be understood that the present invention is not limited to that precisely as shown and described herein.

What is claimed is:

1. A quick release helmet and strap securing assembly comprising:

a helmet having a visor, chin strap means for releasably holding said helmet in place, said chin strap means including a first strap secured to one side of said helmet and carrying a pair of adjacent D-rings, and a second strap secured to the other side of said helmet for threading through both of said D-Rings and then back through the outer one of said pair of D-rings to hold the chin straps in the tightened condition;

means for releasing said chin strap means with one hand, said releasing means including means for slidably engaging said second strap between the point where it goes through both of said D-rings and the point where it extends back through the outer D-ring, and holding means secured to said engaging means for exerting releasing force on said second strap using only one hand; and means for retaining said releasing means to said chin strap means to prevent loss of said releasing means from said assembly, whereby under emergency conditions, for example, when a wasp or a bee is trapped inside a motorcycle rider's helmet visor, the helmet may be easily released and removed with only one hand, with the other hand available to safely guide the motorcycle.

2. A quick release helmet and strap securing assembly defined in claim 1 wherein said retaining means is an enlarged stop member at the end of said second strap.

3. A quick release helmet and strap securing assembly as defined in claim 1 wherein said releasing means includes a closed slot for encompassing said second strap.

4. A quick release helmet and strap securing assembly as defined in claim 1 wherein said retaining means includes a ring of a sufficiently large diameter that it will not slip through the outer D-ring.

5. A quick release helmet and strap securing assembly as defined in claim 1 wherein said releasing means includes a substantilly rectangular opening for receiving said second strap.

6. A quick release helmet and strap securing assembly as defined in claim 1 wherein said releasing means includes an enlarged handle portion.

7. A quick release strap securing assembly for helmets or the like comprising:

strap means for releasably holding a helmet or the like in place, said strap means including a first strap carrying a pair of adjacent rings secured thereto, and a second strap for threading through both of said rings and then back through the outer one of said pair of rings to hold the straps in the tightened condition; and means for releasing said strap means with one hand, said releasing means including loop or ring means for slidably engaging said second strap between the point where it goes through both of said rings and the point where it extends back through the outer ring, and holding means secured to said engaging means for exerting releasing force on said second strap using only one hand;

whereby under emergency conditions the straps may be easily released with only one hand with the other hand of the user available for other purposes.

8. A quick release strap securing assembly as defined in claim 7 further comprising means for securing said releasing means to said assembly to prevent loss thereof.

9. A quick release strap securing assembly as defined in claim 8 wherein said securing means is an enlarged stop member at the end of said second strap.

10. A quick release strap securing assembly as defined in claim 7 wherein said rings have a D-shaped configuration.

* * * * *